United States Patent [19]

James

[11] Patent Number: 4,765,474

[45] Date of Patent: Aug. 23, 1988

[54] PACKAGE OF ENWRAPPED ARTICLES

[75] Inventor: Robert C. James, Sheboygan, Wis.

[73] Assignee: Hayssen Manufacturing Company, Sheboygan, Wis.

[21] Appl. No.: 16,743

[22] Filed: Feb. 19, 1987

[51] Int. Cl.[4] ..... B65D 85/671

[52] U.S. Cl. ..... 206/391; 206/45.34; 206/410; 229/87 R

[58] Field of Search ..... 206/45.33, 45.34, 391, 206/392, 410, 492, 495, 494; 220/461; 229/87 F, 87 R; 383/7, 119, 120, 121

[56] References Cited

U.S. PATENT DOCUMENTS

| | | | |
|---|---|---|---|
| 2,177,894 | 10/1939 | Lasko | 383/119 |
| 2,260,064 | 8/1939 | Stokes | 493/194 |
| 2,331,966 | 10/1943 | Eisgrau | 383/119 |
| 2,699,285 | 1/1955 | Bell et al. | 206/492 |
| 2,802,617 | 8/1957 | Roper | 383/119 |
| 3,011,689 | 12/1961 | Korn et al. | 383/119 |
| 3,027,263 | 11/1958 | Wanamaker | 229/87 B |
| 3,191,849 | 6/1965 | Gutowski et al. | 383/119 |
| 3,249,286 | 5/1966 | Palmer | 229/87 R |
| 3,460,671 | 8/1969 | Harm | 229/87 R |
| 4,050,216 | 9/1977 | Stenberg | 53/413 |
| 4,517,787 | 5/1985 | Kreager | 53/450 |
| 4,535,587 | 8/1985 | Rias | 53/436 |
| 4,566,252 | 1/1986 | Watanabe | 53/410 |

FOREIGN PATENT DOCUMENTS

| | | | |
|---|---|---|---|
| 1097350 | 1/1961 | Fed. Rep. of Germany | 383/119 |

*Primary Examiner*—Jimmy G. Foster

*Attorney, Agent, or Firm*—Senniger, Powers, Leavitt and Roedel

[57] ABSTRACT

A package comprising a wrapper formed from a single web of flexible sheet material formed into a tube having overlapping edge margins sealed together to form a single longitudinal seam for the tube lying substantially in the plane of one wall of the package, and a pair of end seals at opposite ends of the package, at least one end seal comprising end portions of two opposite walls of the tube sealed together in face-to-face relation in a plane extending longitudinally of the tube and generally at right angles to the plane of the overlapping edge margins forming the longitudinal seam.

16 Claims, 2 Drawing Sheets

PACKAGE OF ENWRAPPED ARTICLES

BACKGROUND OF THE INVENTION

This invention relates generally to packaging and more particularly to a package wherein rolls of paper, such as rolls of toilet tissue or paper towel rolls, or enwrapped in flexible sheet wrapping material such as heat-sealable plastic film.

Toilet tissue and household paper towel are typically packaged in quantities of anywhere from two to twenty-four or more rolls. Packaging a quantity of rolls usually involves the use of premade bag, stuffing the bag with the rolls, and sealing the open end of the bag. In many instances where the package is large and relatively heavy, the premade bag has a handle for convenient carrying. There are drawbacks, however, to using premade bags. For example, premade bags generally have side seals on two sides, so that only two sides remain uninterrupted for full-side printing and advertisement. Moreover, the process involved in making, stuffing and then sealing a premade bag is relatively expensive.

Reference may be made to U.S. Pat. Nos. 2,260,064 4,566,252, 4,535,587, 4,517,787, 4,050,216 and 3,027,263 for packaging generally in the field of this invention.

SUMMARY OF THE INVENTION

Among the several objects of this invention may be noted the provision of an improved package of the type referred to above which is formed from a single web of flexible sheet material formed into tube around articles to be enwrapped and sealed; the provision of such a package having only one side seal whereby three sides of the package are uninterrupted by seals for full-side printing thereon; the provision of such a package which may be formed with a handle for convenient carrying; the provision of such a package which is neat in appearance; the provision of such a package which is reinforced against tearing; the provision of such a package wherein such reinforcement is by means of one or more reinforcing strips for economical manufacture; and the provision of such a package which is conducive to an automatic wrapping process for economical manufacture.

Generally, a package of this invention comprises a wrapper formed from a single web of flexible sheet material formed into a tube having overlapping edge margins sealed together to form a single longitudinal seam for the tube lying substantially in the plane of one wall of the package, and a pair of end seals at opposite ends of the package, at least one end seal comprising end portions of two opposite walls of the tube sealed together in face-to-face relation in a plane extending longitudinally of the tube and generally at right angles to the plane of the overlapping edge margins forming said longitudinal seam.

Other objects and features will become in part apparent and will be in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
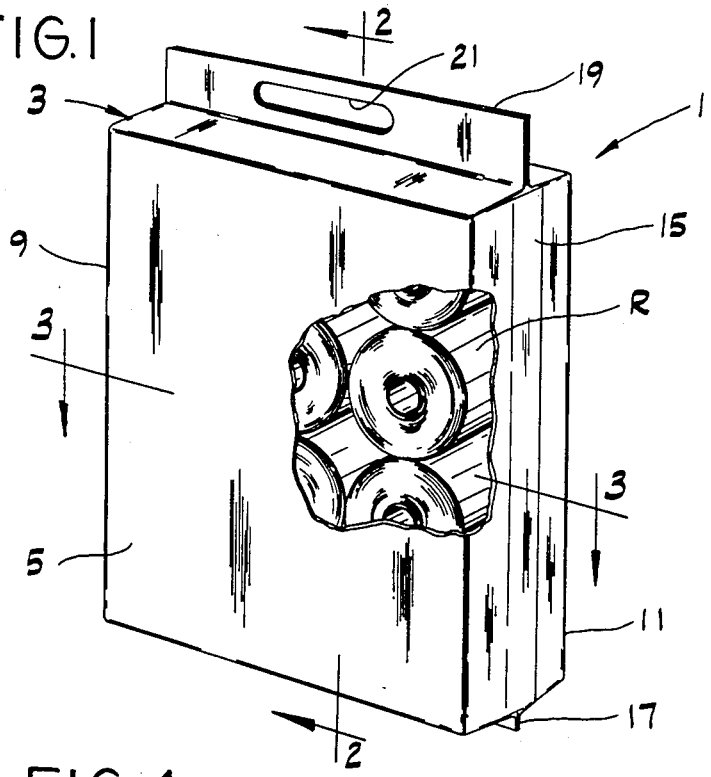
FIG. 1 is a perspective of a package of this invention for paper rolls and the like, portions of the package being broken away to illustrate its contents.
Figure 2:
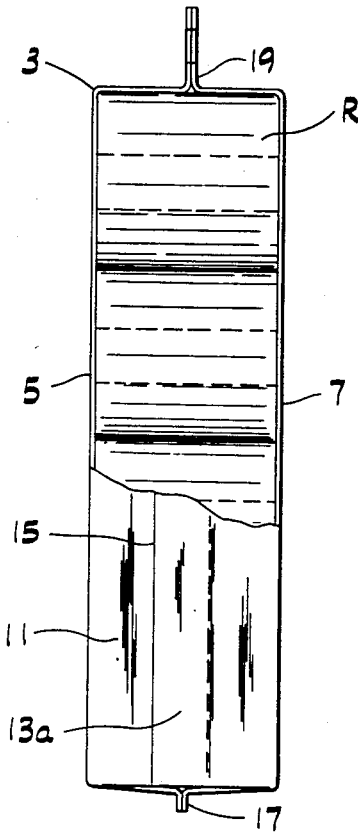
FIG. 2 is a side elevation of the package, with a portion of one side wall broken away.
Figure 3:
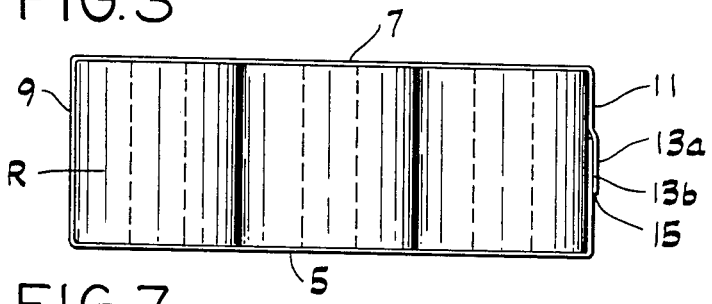
FIG. 3 is a horizontal section taken on line 3—3 of FIG. 1.

Referring now to the drawings; and first more particularly to FIG. 1-3, there is generally indicated at 1 a package of enwrapped articles such as rolls R of paper (e.g., rolls of toilet tissue or paper towel). As illustrated, the package 1 contains 12 rolls, four horizontal rows of three rolls each, but it will be understood that this number and the depicted arrangement may vary without departing from the scope of this invention.

In accordance with this invention, the package 1 comprises a wrapper generally designated 3 formed from a single web of flexible sheet material, such as heat-sealable plastic film (e.g., polyethylene film), formed into a tube around the rolls R, the wrapper being of generally rectangular cross section and thus having front, back and side walls designated 5, 7, 9 and 11, respectively. The tubular wrapper has overlapping edge margins **13*a*, 13*b* at one side of the package sealed (e.g., heat-sealed) together to form a single longitudinal seam 15 for the tube lying substantially in the plane of side wall 11** of the package.

The package 1 has a pair of end seals, one being an end seal 17 at the bottom of the package and the other being an end seal 19 at the top of the package. Each end seal is a fin seal comprising end portions of the front and back walls 5, 7 of the tubular wrapper sealed together in face-to-face relation in a plane exending generally longitudinally of the tube (vertically as shown in FIG. 1) and generally at right angles to the plane of the overlapping edge margins **13*a*, 13*b* of the tube forming longitudinal seam 15. The top end seal 19 extends endwise (upwardly as viewed in the drawings) from the package a distance sufficient to provide a handle with a hand hole 21 in it for convenient carrying of the package. The bottom end seal 17** extends downwardly from the package, but only a relatively short distance (which should be sufficient to provide a strong seal).

It will be observed that the wrapper 3, being formed from a single tube of wrapping material sealed in the manner described, has three uninterrupted walls available for full-panel printing, namely, the front and back walls 5, 7 and one side wall 9. Moreover, the handle is no wider than the width of the package, providing for a neat appearance. Also, the fact that the wrapper 3 is formed from a single web of wrapping material is more conducive to an automatic wrapping process for economical manufacture of packages 1.

Figure 4:
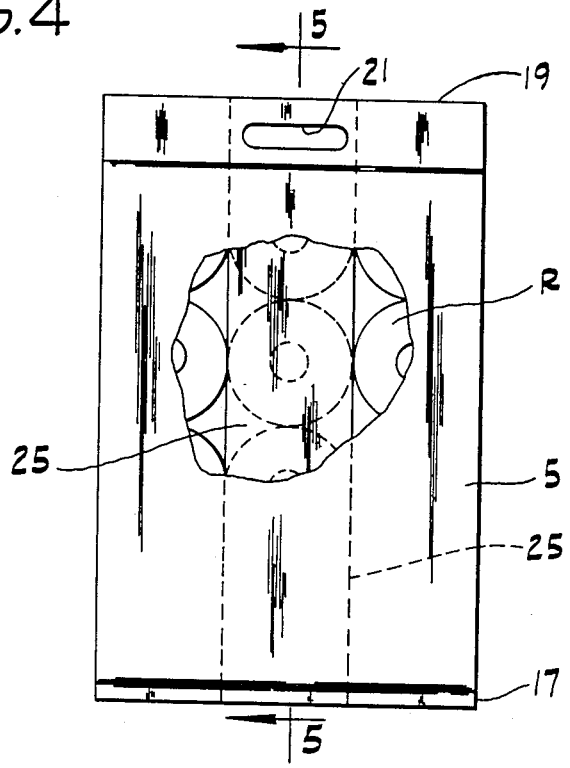
FIG. 4 is a front elevation of a second embodiment of the package incorporating a single reinforcing strip, portions of the front wall of the package being broken away to show the strip.
Figure 5:
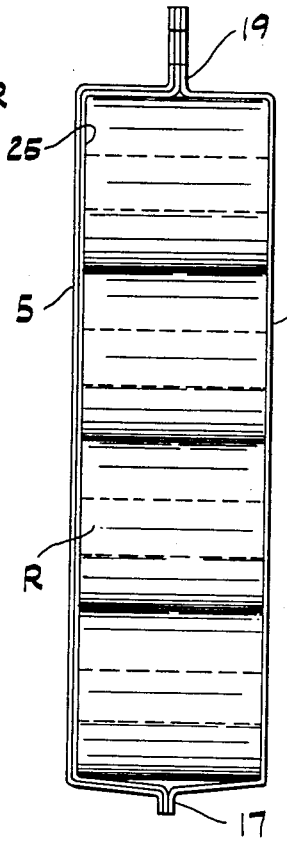
FIG. 5 is a vertical section taken on line 5—5 of FIG. 1.

Referring now to FIGS. 4 and 5, there is shown a package similar to the package 1 described above, the same reference numerals being used to describe corresponding parts of the package. The only difference in construction is the provision of a single reinforcing strip 25 which extends the length of the package on the inside of either the front wall 5 or back wall 7 (as illustrated, the strip is on the inside of the front wall) from one end seal 7 to the other 9. The strip has a width substantially less than the width of the wall 5 or 7 and is disposed generally centrally of the wall (i.e., generally midway between the side walls 9, 11 of the package). Opposite end portions of the reinforcing strip are sealed (e.g., heat-sealed) in with the end seals of the wrapper, the upper end of the strip having an opening therein in register with the hand hole 21. It will be understood that the strip 25 serves not only to reinforce the handle but also to carry part of the package weight. The strip is preferably of a tranparent material so that it does not interfere with the aesthetics of the package.

Figure 6:
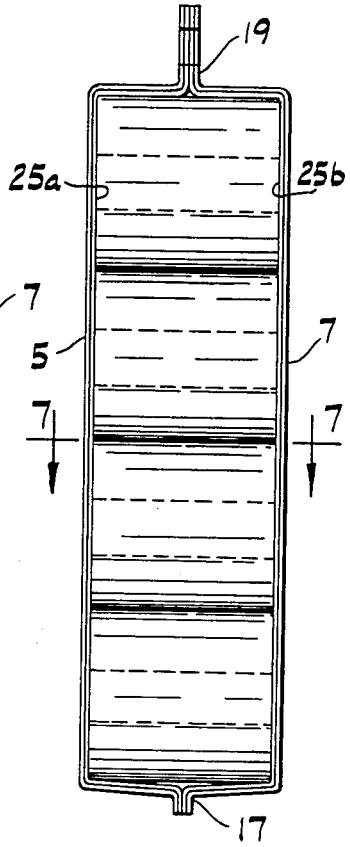
FIG. 6 is a view similar to FIG. 5 showing a different package construction using two reinforcing strips.
Figure 7:
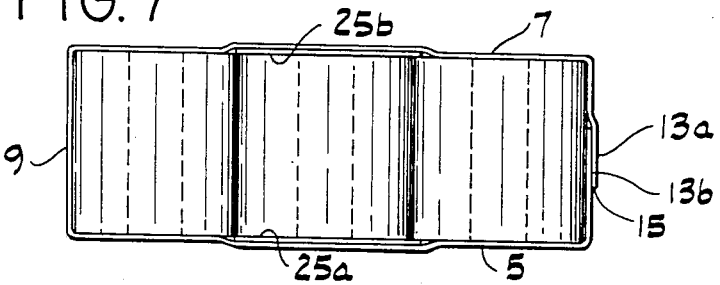
FIG. 7 is a horizintal section on line 7—7 of FIG. 6 showing the reinforcing strips.

FIGS. 6 and 7 show a package identical to the one described in FIGS. 4 and 5 (and thus the same reference numerals are used to identify corresponding parts), except that two reinforcing strips **25*a*, 25*b* are provided, one of which extends on the inside of the front wall 5 and the other of which extends on the inside of the back wall 7** to provide additional reinforcement to the package.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A package of enwrapped articles, such as paper rolls, comprising a wrapper formed from a single web of flexible sheet material formed into a tube having overlapping edge margins sealed together to form a single longitudinal seam for the tube lying substantially in the plane of one wall of the package, and a pair of end seals at opposite ends of the package, at least one end seal comprising end portions of two opposite walls of the tube sealed together in face-to-face relation in a plane extending longitudinally of the tube and generally at right angles to the plane of the overlapping edge margins forming said longitudinal seam.

2. A package as set forth in claim 1 wherein said one end seal extends endwise from the package a distance sufficient to provide a handle for the package.

3. A package as set forth in claim 2 wherein said one end seal has a hand hole therein.

4. A package as set forth in claim, 3 wherein both end seals comprise end portions of two opposite walls of the tube sealed together in face-to-face relation in a plane extending longitudinally of the tube and generally at right angles to the plane of the overlapping edge margins forming said longitudinal seam.

5. A package as set forth in claim 4 further comprising a reinforcing strip extending the length of the package on the inside of one of said two opposite walls of the tube from one end seal to the other, said strip having a width substantially less than the width of said one opposite wall of the tube and being disposed generally centrally of said one opposite wall.

6. A package as set forth in claim 5 wherein opposite end portions of the reinforcing strip are sealed in with the end seals of the wrapper.

7. A package as set forth in claim 6 wherein said web of sheet material and said reinforcing strip are transparent.

8. A package as set forth in claim 4 further comprising a reinforcing strip extending the length of the package on the inside of each of said two opposite walls of the tube from one end seal to the other, each strip having a width substantially less than the width of a respective opposite wall of the tube and being disposed generally centrally of the wall.

9. A package as set forth in claim 8 wherein opposite end portions of each reinforcing strip are sealed in with the end seals of the wrapper.

10. A package as set forth in claim 9 wherein said web of sheet material and said reinforcing strips are transparent.

11. A package as set forth in claim 1 further comprising a reinforcing strip extending the length of the package on the inside of one of said two opposite walls of the tube from one end seal to the other, said strip having a width substantially less than the width of said one opposite wall of the tube and being disposed generally centrally of said one opposite wall.

12. A package as set forth in claim 11 wherein opposite end portions of the reinforcing strip are sealed in with the end seals of the wrapper.

13. A package as set forth in claim 12 wherein said web of sheet material and said reinforcing strip are transparent.

14. A package as set forth in claim 1 comprising a reinforcing strip extending the length of the package on the inside of each of said two opposite walls of the tube from one end seal to the other, each strip having a width substantially less than the width of a respective opposite wall of the tube and being disposed generally centrally of the wall.

15. A package as set forth in claim 14 wherein opposite end portions of each reinforcing strip are sealed in with the end seals of the wrapper.

16. A package as set forth in claim 15 wherein said web of sheet material and said reinforcing strips are transparent.

* * * * *